US009775418B2

(12) United States Patent
Ford et al.

(10) Patent No.: US 9,775,418 B2
(45) Date of Patent: Oct. 3, 2017

(54) HAIR STYLING APPLIANCE

(75) Inventors: Tom Ford, Royston (GB); Richard Sims, Cambridge (GB); John Allan Sinclair, Cambridge (GB); Jamie McPherson, Cambridge (GB)

(73) Assignee: Jemella Ltd., Leeds (GB)

( * ) Notice: Subject to any disclaimer, the term of this patent is extended or adjusted under 35 U.S.C. 154(b) by 0 days.

(21) Appl. No.: 13/510,417

(22) PCT Filed: Aug. 12, 2011

(86) PCT No.: PCT/GB2011/051520

§ 371 (c)(1),
(2), (4) Date: May 17, 2012

(87) PCT Pub. No.: WO2012/028862

PCT Pub. Date: Mar. 8, 2012

(65) Prior Publication Data

US 2012/0227758 A1 Sep. 13, 2012

(30) Foreign Application Priority Data

Aug. 31, 2010 (GB) ..... 1014424.4
Dec. 3, 2010 (GB) ..... 1020598.7

(51) Int. Cl.
*A45D 1/04* (2006.01)
*A45D 1/28* (2006.01)
*A45D 2/00* (2006.01)

(52) U.S. Cl.
CPC ..... *A45D 1/04* (2013.01); *A45D 1/28* (2013.01); *A45D 2/001* (2013.01)

(58) Field of Classification Search
CPC ... A45D 1/04; A45D 1/06; A45D 1/28; A45D 7/02
(Continued)

(56) References Cited

U.S. PATENT DOCUMENTS 4,045,763 A 8/1977 Miyamoto et al.
4,151,401 A 4/1979 Van Bokestal et al.
(Continued)

FOREIGN PATENT DOCUMENTS

EP 2106194 3/2008
EP 2110040 6/2008
(Continued)

OTHER PUBLICATIONS

UK Intellectual Property Office Examination Report dated Jul. 21, 2011 for Patent Application GB1020598.7.
(Continued)

*Primary Examiner* — Todd E Manahan
*Assistant Examiner* — Brianne Kalach
(74) *Attorney, Agent, or Firm* — Trego, Hines & Ladenheim, PLLC

(57) ABSTRACT

The invention relates to a hair styling appliance (100, 100', 100") comprising at least one heater (103, 104) having a plurality of heating zones (Z1-Z5). The heating zones are independently operable arranged along the length of the heater. The sequential arrangement of the independently operable heating zones helps to improve the thermal control of the hair styling appliance. The hair styling appliance may be a hair straightener, curling tong, curling wand or a crimping iron.

26 Claims, 7 Drawing Sheets

(58) Field of Classification Search
USPC ..... 219/222–226, 245; 132/223–227, 229, 132/231–232, 263
See application file for complete search history.

(56) References Cited

U.S. PATENT DOCUMENTS

| | | | | | |
|---|---|---|---|---|---|
| 4,242,567 | A | | 12/1980 | Carter | |
| 4,841,127 | A | * | 6/1989 | Prager et al. | 219/225 |
| 5,345,055 | A | | 9/1994 | Leung | |
| 5,345,060 | A | | 9/1994 | Hazan et al. | |
| 6,026,821 | A | * | 2/2000 | Last | 132/200 |
| 6,173,718 | B1 | * | 1/2001 | Okumoto et al. | 132/224 |
| 7,783,177 | B2 | * | 8/2010 | Ikesaki | A45D 1/04 132/229 |
| 2004/0003824 | A1 | * | 1/2004 | Habibi | 132/224 |
| 2006/0108344 | A1 | * | 5/2006 | Kim et al. | 219/225 |
| 2009/0032048 | A1 | * | 2/2009 | Suzuki et al. | 132/224 |
| 2009/0044823 | A1 | | 2/2009 | Overend et al. | |
| 2009/0260650 | A1 | * | 10/2009 | Jung | 132/224 |
| 2010/0089413 | A1 | * | 4/2010 | Wright et al. | 132/211 |
| 2011/0253164 | A1 | * | 10/2011 | Morgandi et al. | 132/211 |

FOREIGN PATENT DOCUMENTS

| | | | | |
|---|---|---|---|---|
| EP | 2106195 | | | 3/2009 |
| FR | WO 2010081969 | | * | 7/2010 |
| GB | 2405584 | | | 9/2005 |
| GB | 2459507 | A | | 10/2009 |
| GB | 2465865 | | | 9/2010 |
| JP | S45004672 | | | 1/1970 |
| JP | S4840419 | | | 1/1973 |
| JP | S56176856 | | | 1/1981 |
| JP | S6075006 | | | 4/1985 |
| JP | H10117835 | | | 5/1985 |
| JP | S6229135 | | | 2/1987 |
| JP | S6233367 | | | 2/1987 |
| JP | S6277892 | | | 4/1987 |
| JP | S62134431 | | | 6/1987 |
| JP | H04033602 | | | 5/1992 |
| JP | H05212199 | | | 8/1993 |
| JP | H08153570 | | | 6/1996 |
| JP | 11169600 | | | 6/1999 |
| JP | 2001143851 | | | 5/2001 |
| JP | 2005087258 | A | | 4/2005 |
| JP | 2006122313 | | | 5/2006 |
| JP | 2006212222 | | | 8/2006 |
| JP | 2009031117 | | | 2/2009 |
| JP | 2009254796 | | | 11/2009 |
| KR | 10-2009-0071266 | | * | 5/2010 |
| KR | 100959792 | | | 5/2010 |
| NL | WO2007000700 | | * | 1/2007 |
| WO | 2005023046 | | | 3/2005 |
| WO | 2005023046 | A1 | | 3/2005 |
| WO | 2007000700 | | | 1/2007 |
| WO | 2008062293 | A1 | | 5/2008 |
| WO | 2010016072 | | | 2/2010 |

OTHER PUBLICATIONS

UK Intellectual Property Office Search Report dated Jan. 26, 2011 for Patent Application GB1020598.7.

Kempthorne, Max, Iponz First Examination Report, Oct. 7, 2013, New Zealand.

Kempthorne, Max, Iponz Further Examination Report, Apr. 10, 2014, New Zealand.

Mexican Institute of Industrial Property, Office Action for Application No. MS/a/2013/002099, May 15, 2015, Mexico.

The State Intellectual Property Office of the People's Republic of China, Office Action for Application No. 2011800525292, Mar. 9, 2015. China.

Russian Federation, Office Action for Application No. 2013114367, May 2015, Russia.

Williams, Mark, European Search Report, Apr. 22, 2016, European Patent Office, Munich, Germany.

Murayam, Mutsumi, Notice of Reasons for Rejection, Dec. 5, 2016, Japanese Patent Office, Japan.

* cited by examiner

HAIR STYLING APPLIANCE

FIELD OF INVENTION

This invention relates to hair styling appliances that are suitable for styling hair.

BACKGROUND TO THE INVENTION

A hair styling appliance is a thermal device for styling hair. A hair styling appliance styles hair by heating the hair above a transition temperature where it becomes mouldable. Depending on the type, thickness, condition and quantity of hair, the transition temperature may be a temperature in the range of approximately 160° C.-200° C.

A hair styling appliance can be employed to straighten, curl and/or crimp hair.

A hair styling appliance for straightening hair is commonly referred to as a "straightening iron" or "hair straightener". FIG. 1 depicts an example of a typical hair straightener (1). The hair straightener (1) includes first and second jaws (2*a*, 2*b*). Each jaw comprises a heater that includes a heating element (not shown) arranged in thermal contact with a heatable plate (3*a*, 3*b*). The heatable plates are substantially flat and are arranged on the inside surfaces of the jaws in an opposing formation. During the straightening process, the hair is clamped between the hot heatable plates and then pulled under tension through the plates so as to mould it into a straightened form. The hair straightener may also be used to curl hair by rotating the hair straightener 180° towards the head prior to pulling the hair through the hot heatable plates.

Hair styling appliances for curling hair include "curling tongs" and "curling wands". FIG. 2 depicts an example of a typical curling tong (1'). The curling tong includes first and second jaws (2*a*', 2*b*'). The first jaw comprises a heater having a cylindrical or rod-like form. The heater includes a heating element arranged in thermal contact with a substantially cylindrical heatable plate (3'). The second jaw comprises a clamp portion (4') with a concave cylindrical clamp face that is shaped to conform to the cylindrical heatable plate. During the curling process, the hair is wound around the hot cylindrical heatable plate (3') and clamped by the clamp portion (4') until it is moulded into a curled form.

A hair styling appliance for crimping hair is commonly referred to as a "crimping iron". FIG. 3 depicts an example of a typical crimping iron (1"). The crimping iron includes first and second jaws (2*a*", 2*b*"). Each jaw comprises a heater. Each heater includes a heating element arranged in thermal contact with heatable plate (3*a*", 3*b*"). The heating plates have a saw tooth (corrugated, ribbed) configuration surface and are arranged on the inside surfaces of the jaws in an opposing formation. During the crimping process, the hair is clamped between the hot heatable plates until it is moulded into a crimped shape.

FIG. 4 schematically depicts an internal arrangement (10) of a typical hair styling appliance. This particular internal arrangement relates to a hair straightener having a pair of heaters (11*a*, 11*b*) as depicted in FIG. 1. The hair styling appliance includes a control PCB (12) having voltage detection means (13) and thermal control means (14). The voltage detection means is provided to control the input voltage from the power supply (15). The thermal control means is provided to control the operation of the heaters. One or more temperature sensors (16) are mounted in association with the heaters so as to provide feedback control data to the thermal control means. A user interface (17) is provided to allow a user to control the operation of the hair appliance as required.

Conventional hair styling appliances are typically characterised by a lack of thermal control. The lack of thermal control can restrict the styling performance of a hair styling appliance and/or may cause damage to the hair. For example, a hair styling appliance with limited thermal control may provide a fluctuating, uneven, excessive and/or insufficient heating effect. The hair styling appliance may provide an uncontrollable heating effect whereby the temperature of a heating plate fluctuates during the styling process. The hair styling appliance may provide an undesirable heating effect whereby the temperature varies along the length of a heater. The hair styling appliance may provide an excessive heating effect whereby a heatable plate becomes hot enough to damage hair, particularly "virgin" hair on top of the head. The hair styling appliance may provide an insufficient heating effect whereby a heatable plate does not become or remain hot enough to heat the hair to the transition temperature. This may result in repeated use of the hair styling appliance which can cause damage and cuticle stripping.

The thermal control may be compromised if the hair styling appliance has a long thermal time constant. The thermal time constant may be unduly long if a heatable plate has poor thermal conductivity and/or a large thermal mass. The long thermal time constant may cause the temperature of the heatable plate to fluctuate during the styling process due to a time lag between the dissipation of heat from the heatable plate to the hair and supply of heat from a heating element to the heatable plate. This thermal control problem is exacerbated if the hair styling appliance is used to style thicker, wetter and/or greasier hair. Thicker, wetter and/or greasier hair has a larger heat mass than average hair and it so requires more heat energy to be delivered to the hair during the styling process. Accordingly, the temperature of the heatable plate is likely to drop below the transition temperature whilst styling these types of hair and so the performance of the hair styling appliance is compromised. Previously, this thermal control problem has been addressed by using a higher starting temperature so as to try and maintain the temperature of the heatable plate above the transition temperature. However, it has been found that this higher starting temperature is likely to cause damage to the hair and so it is an unsuitable solution.

The thermal control of a hair styling appliance may be compromised by the position of the temperature sensor. In normal use, it is rare for hair to be evenly loaded along the length of the heatable plate. Indeed, hair is typically loaded at one end of the heatable plate. If the temperature sensor is arranged in association with the unloaded region of the heatable plate, then it will erroneously determine the heatable plate is at the desired operating temperature, even though the loaded region of the heatable plate is cooling as it dissipates heat to the hair. Hence, a temperature gradient will form along the length of the heatable plate and the hair styling appliance will not provide a sufficient heating effect on the hair. Alternatively, if the temperature sensor is arranged in association with the loaded region of the heatable plate, it will detect the cooling of the loaded region. The heating element will then be activated to provide further heating of the heatable plate and thereby maintain the loaded region of the heatable plate at the desired operating temperature. Since the unloaded region has not dissipated any heat to the hair, the further heating will create a temperature gradient along the length of the heatable plate. Moreover, the further heating of the heatable plate can result in the temperature of the unloaded region becoming hot enough to cause damage to any hair that strays into the unloaded region.

FIG. 5 depicts a schematic exploded view of an example of a conventional heater so as to illustrate the effect of uneven hair distribution. The heater (20) includes a heating element (21), a substantially flat heatable plate (22) and a temperature sensor (23) positioned between the heatable plate and the heating element. The heating element is arranged in thermal contact with the heatable plate so as to heat the plate during use. The temperature sensor is positioned towards the first end (22*a*) of the heatable plate. Hence, the temperature sensor is able to detect the temperature of the first end region of the heatable plate. In accordance with normal usage, the hair (24) is unevenly loaded in the hair styling appliance and is positioned close to the second end (22*b*) of the heatable plate. Hence, the second end region of the heatable plate is arranged in thermal contact with the hair so as to heat the hair. Since the temperature sensor is remote from the hair, the temperature sensor does not detect the cooling of the second end region of the heatable plate as it dissipates heat to the hair. Accordingly, a temperature gradient is created along the length of the heating plate as the second end region of the heating plate becomes cooler than the first end region of the heating plate.

SUMMARY OF THE INVENTION

Embodiments of the invention seek to provide an improved and alternative hair styling appliance and method for styling hair. Embodiments of the invention seek to minimise, overcome or avoid at least some of the problems and disadvantages associated with aforementioned prior art hair styling appliances. Embodiments of the invention seek to provide a hair styling appliance with improved thermal control. Embodiments of the invention seek to provide a hair styling appliance that can provide a substantially uniform heating effect.

A first aspect of the invention relates to a hair styling appliance comprising at least one heater having a plurality of heating zones, whereby the heating zones are individually controllable and arranged along the length of the heater.

The heating zones are configured so as to provide a heater with a desired heating effect. For example, the heating zones may be individually controlled so as to provide a substantially uniform heating effect along the length of the heater (i.e. at least substantially maintain a constant temperature along the length of the heater). The heating zones may be individually controlled so as to provide a substantially uniform heating effect throughout the styling process. The heating zones may be individually controlled in accordance with the type, thickness, quality, condition and/or distribution of hair. Advantageously, the heater is able to at least minimise (reduce, overcome) any temperature gradient problems that occur during use, for example, when hair is unevenly distributed along the length of the heater. Alternatively, the heating zones may be individually controlled so as to provide a non-uniform heating effect.

The heater may further comprise heating zones arranged across the width of the heater. The heater may comprise heating zones arranged along the length and across the width of the heater in a two-dimensional array. The two-dimensional array may have regular or non-regular grid-like formation.

The heater may comprise heating means and a heatable plate, whereby each heating zone is defined by heating means arranged in thermal contact with a portion of the heatable plate.

In an alternative embodiment, the heater may comprise heating means and a plurality of heatable plates, whereby each heating zone is defined by heating arranged in thermal contact with one of the thermal plates.

The heater may comprise temperature sensing means arranged in thermal contact with the heatable plate of one or more heating zones.

The heating means of each heating zone are configured to provide the heating zone with an individually controllable heating effect. The heating means may comprise one or more heating elements. The heating means may comprise one or more overlapping heating elements. The heating means may comprise a stacked array of heating elements.

At least one heating element may comprise heat transfer means for thermally engaging an adjacent heating element. The heat transfer means may comprise one or more finger portion protruding from the heating element.

At least one heating element may be configured to reduce the power density in a border region between the heating element and an adjacent heating element. For example, the heating element may be arranged a predetermined distance from an adjacent heating element. Additionally or alternatively, the heating element may comprise a reduced power density region that is configured to face the adjacent heating element.

The heating zones may comprise resilient, insulating means to insulate the heating means and improve thermal contact between the heating means and heatable plate.

The hair styling appliance may comprise a control system for controlling the operation of the heating zones. The control system may comprise a flexible printed circuit board coupled to the heating zones. The control system may comprise sensing means for detecting changes in the position or movement of the hair styling appliance, predicting the intended use of the hair styling appliance and operating the heating zones according to the predicted use. The control system may comprise sensing means for detecting characteristics of the hair loaded on the heater and operating the heating zones accordingly.

The hair styling appliance may comprise a hair straightener, curling tong, curling wand or a crimping iron.

The hair styling appliance may comprise one or more cooling zones. The one or more cooling zones may be independently operable. The one or more cooling zones may each be defined by cooling means configured to direct cooling air over hair heated in the hair styling appliance. The one or more cooling zones may each be defined by cooling means arranged in thermal contact with one or more respective cooling plates. The cooling means may comprise micro-refrigeration means and/or thermoelectric cooling means.

A second aspect of the invention relates to a heater comprising a plurality of independently controllable heating zones arranged along the length of the heater.

The heater comprises any of the heater features of the first aspect of the invention.

A third aspect of the invention relates to a method of operating a hair styling appliance according to the first aspect of the invention comprising controlling the supply of power to the heating means of each of the heating zones so as to provide a desired heating effect.

A fourth aspect of the invention relates to a hair styling appliance comprising at least one heater arranged in thermal contact with a portion of a heatable plate and further comprising one or more cooling zones.

DRAWINGS

For a better understanding of the invention and to show how it may be carried into effect reference shall now be made, by way of example only, to the accompanying drawings in which.

Figure 14:
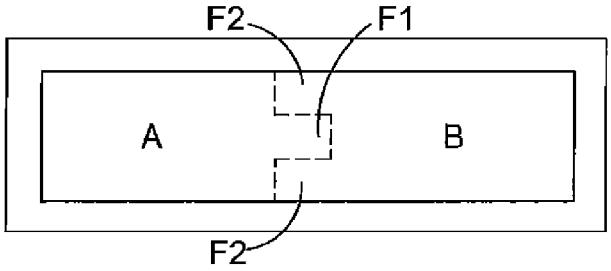
Figure 15:
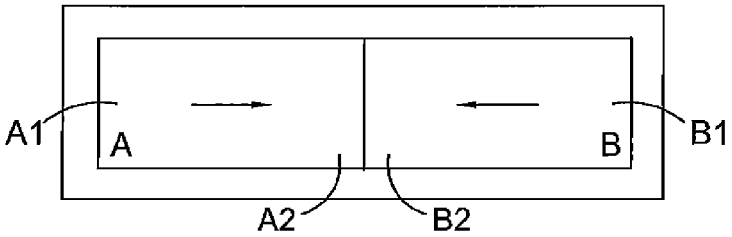
Figure 16A:
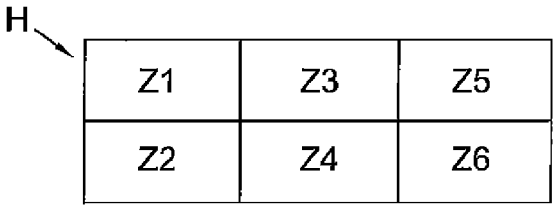
Figure 16B:
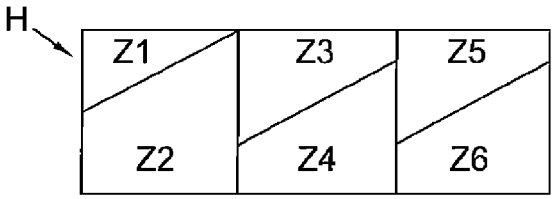
Figure 17:
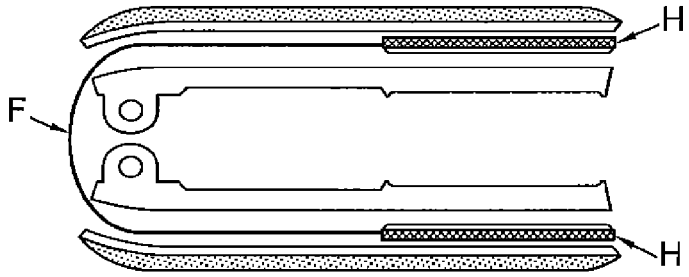
Figure 18:
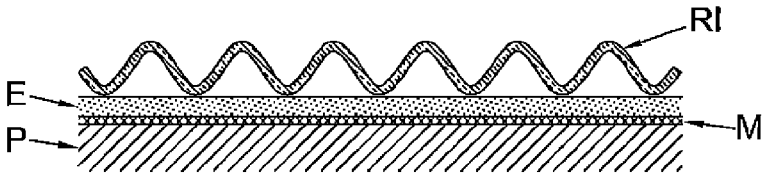
Figure 19:
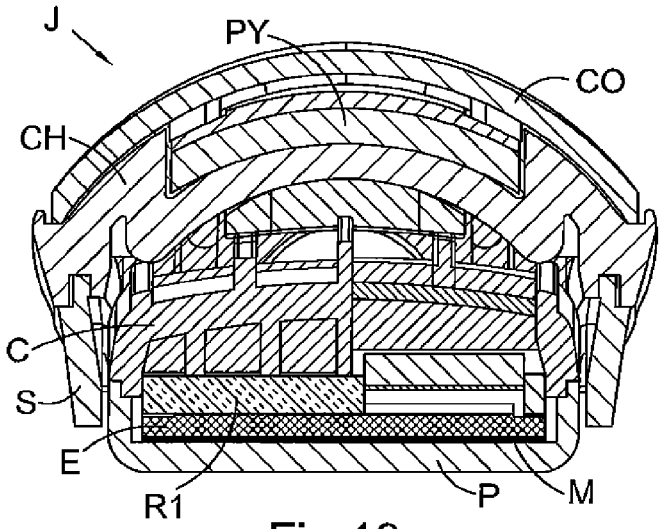
Figure 20:
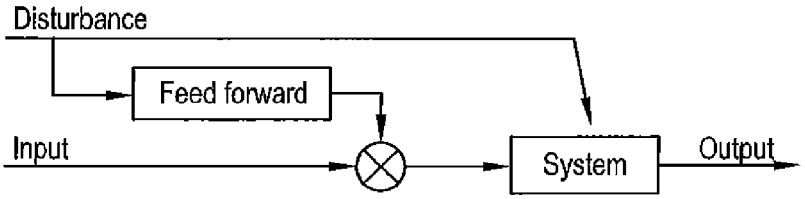

FIGS. 13*a* -13*d* depict schematic side views and a plan view to illustrate the zoned heating effect under different operating voltage conditions;

FIG. 14 depicts a schematic view to illustrate an example of how adjacent heating elements can be arranged in thermal contact;

FIG. 15 depicts a schematic view to illustrate an example of how the power density in the border region of adjacent heating elements can be reduced;

FIG. 16*a* depicts an overview of an example of a heater having a regular grid formation of heating zones;

FIG. 16*b* depicts an overview of an example of a heater having a non-regular grid formation of heating zones;

FIG. 17 depicts a schematic side view of flexible printed circuit board mounted in a hair styling appliance according to the invention;

FIG. 18 depicts a cross-sectional view to illustrate an example of a resilient insulating means;

FIG. 19 depicts a cross-sectional view of an example of a jaw of a hair styling appliance according to the invention;

FIG. 20 depicts an example of feed forward control architecture of the hair styling appliance according to the invention.

DETAILED DESCRIPTION OF THE INVENTION

The invention relates to a hair styling appliance comprising at least one heater. The heater comprises a plurality of heating zones. The heating zones are independently operable and arranged along the length of the heater.

The heating zones comprise heating means arranged in thermal contact with heatable plate.

The heatable plate of each heating zone may be a portion of a single, large heatable plate or may be an individual, smaller heatable plate. The heatable plate comprises a hair engaging surface to contact the hair when the hair styling appliance is in use. The heatable plate may comprise an aluminium plate. The hair engaging surface of the aluminium plate may comprise a coating (e.g. a ceramic coating) so as to improve the thermal contact with hair.

The heating means of each heating zone are configured to provide the heating zone with an individually controllable heating effect. The heating means may comprise one or more heating elements. The heating means may comprise overlapping heating elements. The heating means may comprise a stacked array of heating elements. The heating elements may be individually operable or collectively operable. The heating means may be part of a heating system comprising a plurality of heating means for heating different heating zones.

The heating means may be selected so as to reduce the thermal resistance between the heating means and heatable plate of the heating zones. The heating means may include one or more of the following heating elements:

- a heating element comprising thick film printed on ceramic. This type of heating element preferably comprises a resistive conductive film layer (metallic, ionic or carbon based) printed (using an inkjet or screen printing process) onto a ceramic base. An enamel layer may be printed on top of the initial resistive conductive layer to allow for the printing of further resistive conductive layers and conductive tracks and also to protect the heating element. Preferably, the thickness of the ceramic base is selected so that the ceramic base is sufficiently thin to reduce the thermal resistance and mass of the heating element and/or reduce the susceptibility of the ceramic base to cracking;
- a heating element comprising thick film printed onto anodised aluminium. This heating element preferably comprises a resistive conductive layer printed directly onto the anodised or oxide side of an aluminium plate. The aluminium plate may be the heatable plate of a heating zone;
- a heating element comprising thin film evaporated onto ceramic or anodised aluminium;
- a flexi heater or a Kapton heater.

The heating means may be a low voltage heating means requiring, for example, a mains voltage supply in the range of approximately 90V-250V AC. Alternatively, the heating means may be an extra low voltage heating means requiring, for example, a safety extra low voltage supply <50V AC or <120V DC One or more heating zones may further comprise temperature sensing means arranged in thermal contact with the heatable plate. The temperature sensing means is arranged so as to detect the temperature of the heatable plate of the heating zone. The temperature sensing means may be configured to provide feed back control data or feed forward control data so as to help regulate the heating effect of the heating zone. The temperature sensing means may comprise one or more temperature sensors arranged in thermal contact with the heatable plate.

The placement of the temperature sensing means on top of the heater or on a surround may lead to inaccurate readings due to poor thermal resistance or contact with the heatable plate. Thus, with regard to thick film heaters, the accuracy of readings may be improved by printing or placing the temperature sensing means for each heating zone directly on to the heating element substrate. Alternatively, the temperature sensing means may be screen printed directly onto the heatable plate of the heating zone. It is anticipated that this arrangement would work well for extra low voltage heaters. For low voltage heaters, a layer of insulator would need to be applied between the temperature sensing means and heatable plate unless the temperature sensing means is isolated.

Figure 1:
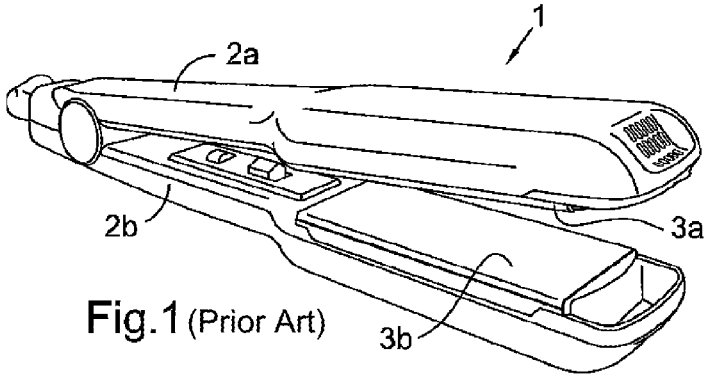
Fig.1 (Prior Art)
FIG. 1 depicts a perspective view of an example of a conventional hair straightener.
Figure 2:
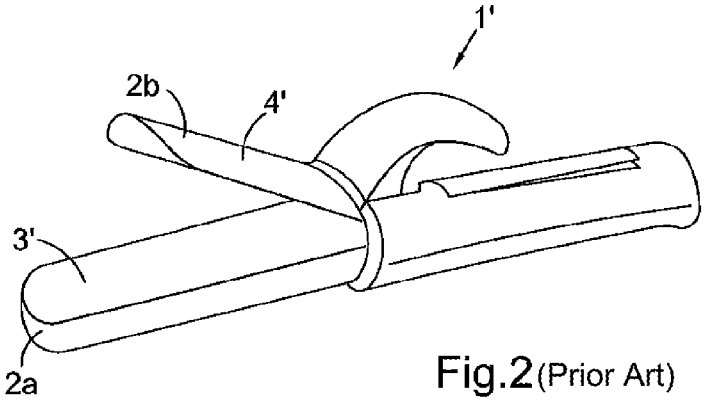
Fig.2 (Prior Art)
FIG. 2 depicts a perspective view of an example of a conventional curling tongs.
Figure 3:
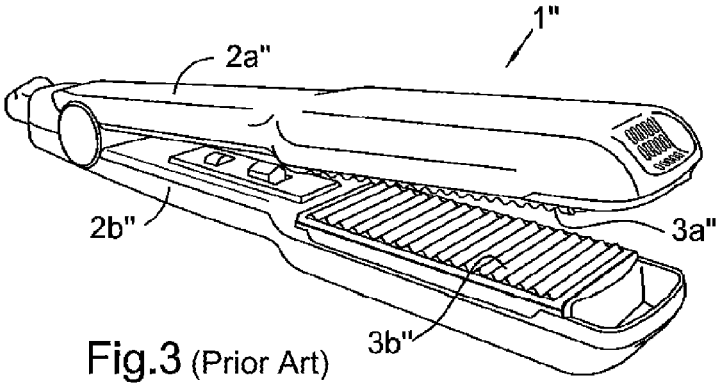
Fig.3 (Prior Art)
FIG. 3 depicts a perspective view of an example of a conventional crimping iron.
Figure 4:
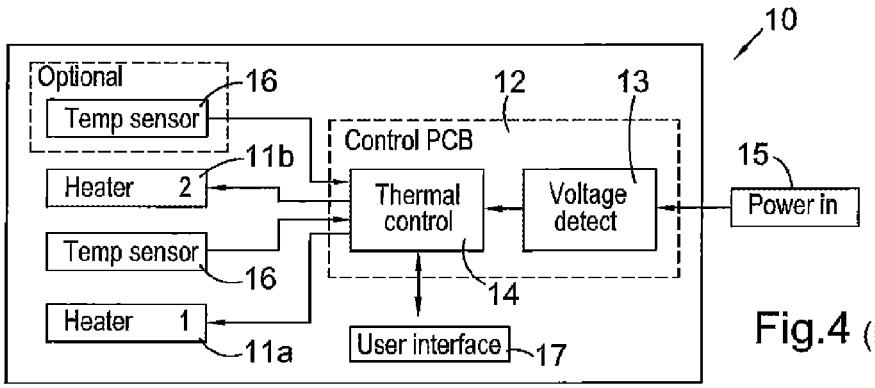
Fig.4 (Prior Art)
FIG. 4 depicts a schematic representation of an internal arrangement of a conventional hair styling appliance.
Figure 5:
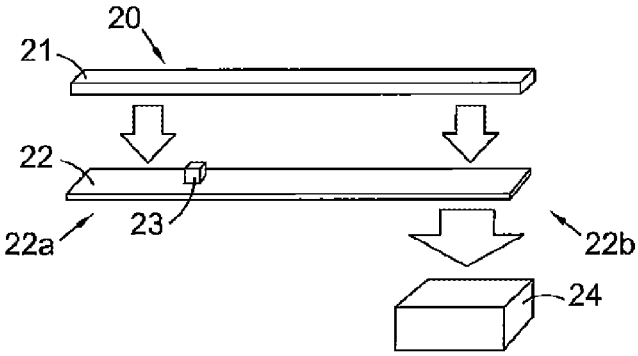
Fig.5 (Prior Art)
FIG. 5 depicts an exploded schematic representation of an example of a heater of a conventional hair styling appliance.
Figure 6:
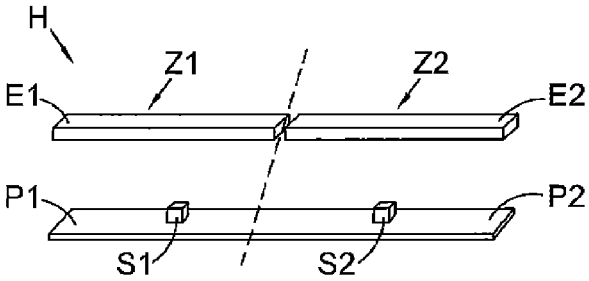
FIG. 6 depicts an exploded schematic representation of the heater of a first embodiment of a hair styling appliance according to the invention.

FIG. 6 is an exploded schematic view depicting an example of a heater of a hair styling appliance according to the present invention. The heater (H) comprises two heating zones (Z1, Z2). The heating zones comprise adjacent portions of a heatable plate and so are spaced longitudinally along the length of the heater. The heating zones are individually controllable because they comprise independently operable heating means. The first heating zone (Z1) comprises a first portion of a heatable plate (P1), a first heating element (E1) arranged in thermal contact with the first portion of the heatable plate and a first temperature sensor (S1) located between the first portion of the heatable plate and first heating element and arranged in thermal contact with the first portion of the heatable plate. The second heating zone (Z2) comprises a second portion of the heatable plate (P2), a second independently operable heating element (E2) arranged in thermal contact with second portion of the heatable plate and a second temperature sensor (S2) located between the second portion of the heatable plate and the second heating element and arranged in thermal contact with the second portion of the heatable plate.

Figure 7:
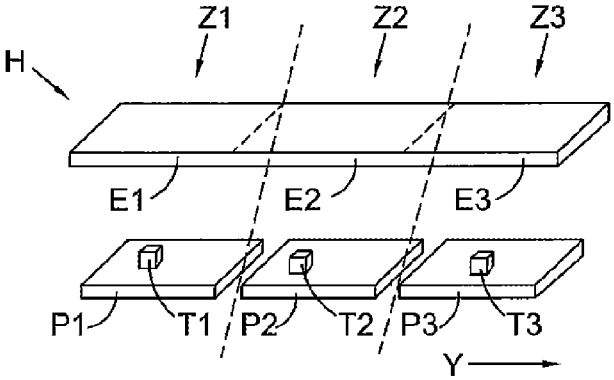
FIG. 7 depicts an exploded schematic representation of the heater of a second embodiment of a hair styling appliance according to the invention.

FIG. 7 is an exploded schematic view depicting a further example of a heater (H) comprising three heating zones (Z1, Z2, Z3). In this example, the heater comprises three individual heatable plates (P1, P2, P3) and a heating system comprising three independently operable heating elements (E1, E2, E3). The heatable plates are arranged sequentially along the length of the length of the heater in a direction parallel to the longitudinal axis of the heater (Y). Each of the heating elements is arranged in thermal contact with a different heatable plate so as to define three individually controllable heating zones (Z1, Z2, Z3) along the length of heater. A respective temperature sensor (T1, T2, T3) is also arranged in thermal contact with each of heatable plates.

The sequential arrangement of independently operable heating zones helps to improve the thermal control of the hair styling appliance. By configuring the heating zones as such, the heating zones can be individually controlled so as to provide a heater with a desired heating effect.

For example, the operation of the heating zones may be controlled so as to provide a heater with a substantially uniform heating effect. The heating zones may be regulated so as to provide a substantially uniform heating effect during the styling process. The heating zones may be regulated to provide a substantially uniform heating effect along the length of the heater. The heating zones may be regulated so as to at least minimise, and preferably prevent, fluctuations in the heating effect during the styling process. The heating zones may be regulated so as to at least minimise, and preferably prevent, any thermal gradient problems along the length of the heater. The heating zones may be regulated so as to at least minimise, and preferably prevent, an excessive and/or insufficient heating effect.

Alternatively, the operation of the heating zones may be controlled so as to provide a heater with a non-uniform heating effect. For example, the heating zones may be regulated so as to provide different heating effects during the styling process. The heating zones may be regulated so as to provide different heating effects along the length of the heater.

The operation of the heating zones may be controlled in accordance with the type of hair (for example thickness, quality, condition, thermal mass of hair) and/or distribution of hair along the heater.

As an example, the operation of the heating zones may be controlled in accordance with the thickness of the hair being styled. Thicker hair has a higher thermal mass than average hair. Therefore, if thicker hair is being styled, the operation of the heating zones may be controlled to provide an optimum heating effect for styling the thicker hair. The operation of each heating zone is controlled by regulating the power supply to the heating means of each heating zone such that the heater provides a substantially constant heating effect at the transition temperature for thicker hair.

In another example, the operation of the heating zones may be regulated to provide an optimum heating effect when hair is unevenly distributed along the length of the heater. The temperature of a heating zone loaded with a substantial amount of hair will drop as it dissipates heat to the hair unless it is supplied with further heat, the temperature of a heating zone loaded with a smaller but still significant amount of hair will also drop though not by as much, whereas the temperature of an unloaded heating zone will remain substantially constant. Accordingly, the operation of each loaded heating zone is controlled by detecting the temperature of the heatable plate of the loaded heating zone and thereby regulating (increasing) the power supply to the heating means of the loaded heating zone so as to at least substantially maintain a desired heating effect on the hair. The operation of each unloaded heating zone is controlled by detecting the temperature of the heatable plate of the unloaded heating zone and thereby regulating (possibly decreasing) the power supply to the heating means of the unloaded heating zone so that the heatable plate of the unloaded zones it is at least substantially maintained at the same temperature as the heatable plate of the loaded heating zones. Accordingly, a substantially constant heating effect (temperature) is maintained along the length of the heater.

Figure 8:
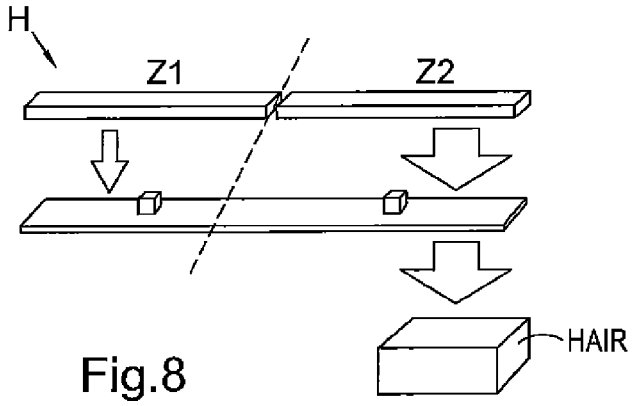
FIG. 8 depicts an exploded schematic representation of the zoned heating effect on unevenly distributed hair.

FIG. 8 depicts an exploded schematic view of an example of a heater (H) so as to illustrate the zoned heating effect on unevenly distributed hair. The heater comprises two independently operable heating zones (Z1, Z2) spaced longitudinally along the heater as depicted in FIG. 6. Hair (HAIR) is arranged unevenly on the heater such that it is substantially located in the second heating zone Z2. The operation of each heating zone is regulated so as to minimise the temperature differential between the heating zones and thereby provide a substantially uniform heating effect along the length of the heater.

The operation of the heating zones may be regulated to provide a variable heating effect during the styling process. For example, it may be desirable for the heating zones of a heater to provide a first heating effect during a first time period of the styling process and then a second heating effect during a second time period of the styling process. The first heating effect may be provided to heat the hair to transition temperature where it becomes mouldable. The second heating effect may be cooler than the first heating effect and may be provided to allow the hair to cool and thereby help set the moulded shape of the hair, bevel the hair, volumise the hair and/or lift the roots of the hair.

The hair styling appliance according to the present invention may be suitable for straightening, curling and/or crimping hair. The hair styling appliance may be a hair straightener, curling tong, curling wand or crimping iron.

Figure 9:
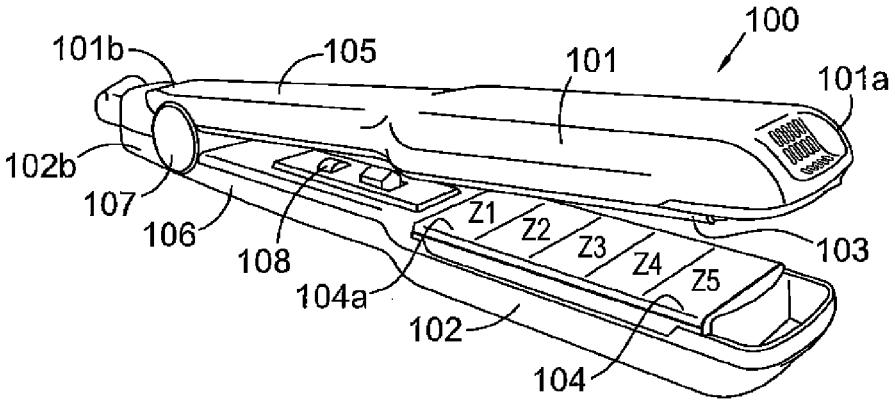
FIG. 9 depicts a perspective view of an example of a hair straightening appliance according to the invention.

The hair styling appliance may be a hair straightener whereby hair is styled by pulling it under tension between a pair of heaters. One or both of the heaters may comprise a plurality of heating zones as described above. FIG. 9 depicts an example of hair straightener (100) according to the present invention. The hair straightener (100) includes first and second jaws (101, 102). Each jaw comprises a heater (103, 104) having a five heating zones (Z1, Z2, Z3, Z4, Z5). The first heater is arranged towards the first end of the first jaw (101*a*). Likewise, the second heater is arranged towards the first end of the second jaw (102*a*), opposing the first heater. Each heater comprises a flat heatable plate (104*a*) and heating means (not shown). The heating means are arranged in thermal contact with different portions of the flat heatable plate so as to define the five heating zones (Z1, Z2, Z3, Z4, Z5) along the heater. The five heating zones are individually controllable and are arranged sequentially along the length of the heater. Hence, the operation of the heating zones can be controlled so that the heaters can provide a desired heating effect.

The jaws of the hair straightener further comprise first and second handle portions (105, 106). The first and second handle portions are positioned towards the respective second ends (101*b*, 102*b*) of the jaws thereof. The jaws are pivotally connected adjacent their second ends by a hinge (107). Thus, the jaws may thus be moved between an open and closed configuration. A spring (not shown) biases the jaws towards the open configuration. The hair straightener further comprises a user interface (108) to control the operation of the hair styling device. The user interface may include switches and/or buttons to the turn the hair straightener on/off, to select a desired operating temperature of the hair straightener and/or to select a desired operating voltage of the hair straightener.

During the straightening process, the heating zones are regulated so that the heaters provide a desired heating effect, the hair is clamped between the heaters and pulled under tension through the heaters so as to mould it into a straightened form. The hair straightener may also be used to curl hair by rotating the hair straightener approximately 180° towards the head prior to pulling the hair through the heaters.

Figure 10:
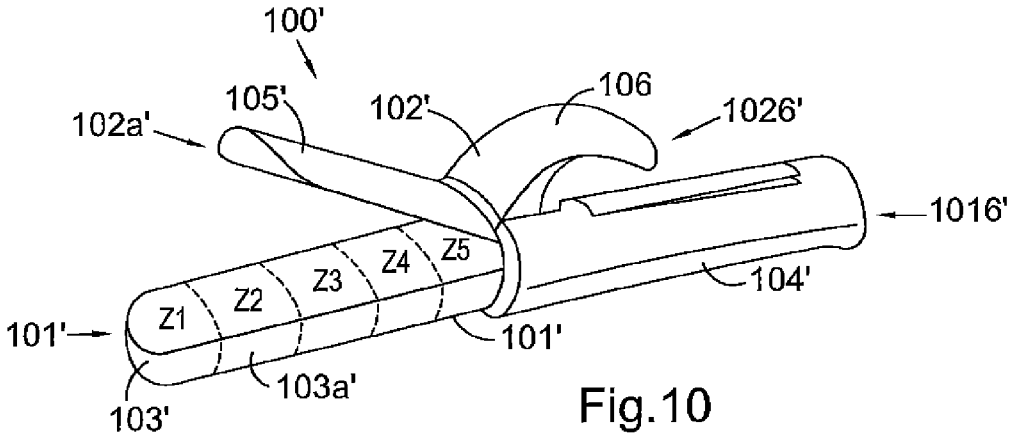
FIG. 10 depicts a perspective view of an example of a curling tong appliance according to the invention.

The hair styling device according to the present invention may be a curling tong whereby hair is curled by winding it around a cylindrical shaped heater. FIG. 10 depicts an example of a curling tong (100') according to the present invention. The curling tong (100') includes first and second jaws (101', 102'). The first jaw comprises a heater (103') positioned towards the first end of the first jaw (101*a*'). The first jaw further comprises a handle portion (104') positioned towards the second end of the first jaw (101*b*').

The heater (103') has a generally cylindrical or rod-like form and comprises a generally cylindrical heatable plate (103*a*') and heating means (not shown). The heating means are arranged in thermal contact with five different portions of the heatable plate so as to define five heating zones (Z1, Z2, Z3, Z4, Z5). The heating zones are independently operable and spaced along the length of the heater. In use, the operation of the heating zones may be controlled so that the heater provides a desired heating effect.

The second jaw comprises a clamp portion (105') with a concave cylindrical clamp face that is shaped to conform to the cylindrical heater. The clamp portion is positioned towards the first end of the second jaw (102*a*'). The second jaw further comprises a lever portion (106') positioned towards the second end of the second jaw (102*b*'). The second jaw is pivotally attached to the handle portion of the first jaw. Thus, the jaws may be moved from a closed to an open configuration by pressing the lever towards the handle. A spring (not shown) biases the jaws towards the closed configuration. The curling tong may further comprise a user interface (not shown) to allow the user to control the operation of the curling tong.

During the curling process, the operation of the heating zones is controlled so as to provide a desired heating effect, the hair is wound around the heater and then clamped by the clamp portion until it is moulded into a curled form.

The hair styling appliance may be a curling wand whereby hair is curled by winding it around a heater. The heater of the curling wand has a generally cylindrical or rod-like form. The diameter of the heater may be substantially constant along the length of the heater. Alternatively, the diameter of the heater may decrease along the length of the heater such that it has a tapered shape. The heater comprises multiple, independently operable heating zones spaced along the length of the heater. In use, the operation of the heating zones may be controlled to provide a desired heating effect.

Figure 11:
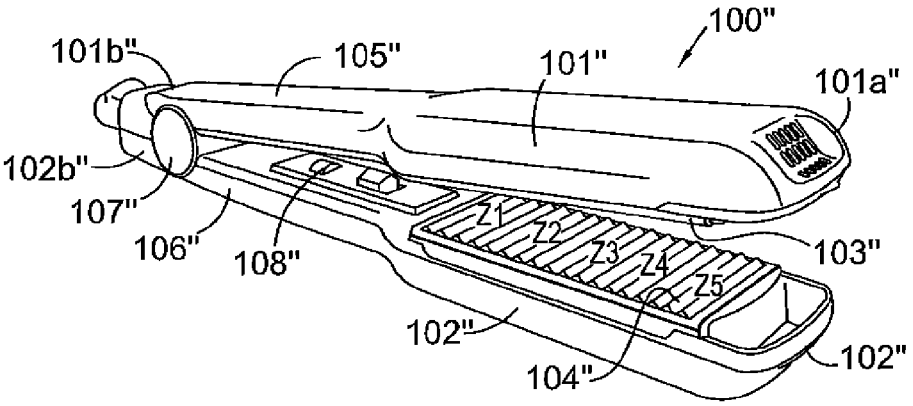
FIG. 11 depicts a perspective view of an example of a crimping iron appliance according to the invention.

The hair styling appliance may be a crimping iron whereby hair is crimped by clamping the hair between a pair of heaters. One or both of the heaters may comprise a plurality of heating zones as described above. FIG. 11 depicts an example of crimping iron (100") according to the present invention. The crimping iron (100") includes first and second jaws (101", 102"). Each jaw comprises a heater having five heating zones (Z1, Z2, Z3, Z4, Z5). A first heater (103") is arranged towards the first end of the first jaw (101*a*"). A second heater (104") is arranged towards the first end of the second jaw (102*a*"), opposing the first heater. Each heater comprises a heatable plate with a saw tooth configuration (104*a*") and heating means (not shown). The heating means are arranged in thermal contact with different portions of the heatable plate so as to define five heating zones (Z1, Z2, Z3, Z4, Z5) along the heater. The heating zones are independently operable an arranged sequentially along the length of the heater. In use, the heating zones are individually controlled so that the heaters provide a desired heating effect.

The jaws further comprise first and second handle portions (105", 106') respectively. The first and second handle portions are positioned towards the respective second ends (101*b*", 102*b*") of the jaws thereof. The jaws are pivotally connected adjacent their second ends by hinge (107"). The jaws may thus be moved between open and closed configurations. A spring (not shown) biases the jaws toward the open configuration. The crimping iron further comprises a user interface (108") so the user may selectively control the operation of the crimping iron.

During the crimping process, the heating zones are independently controlled so the heaters provide a desired heating effect and the hair is clamped between the heaters until it is mould into a crimped shape.

Figure 12:
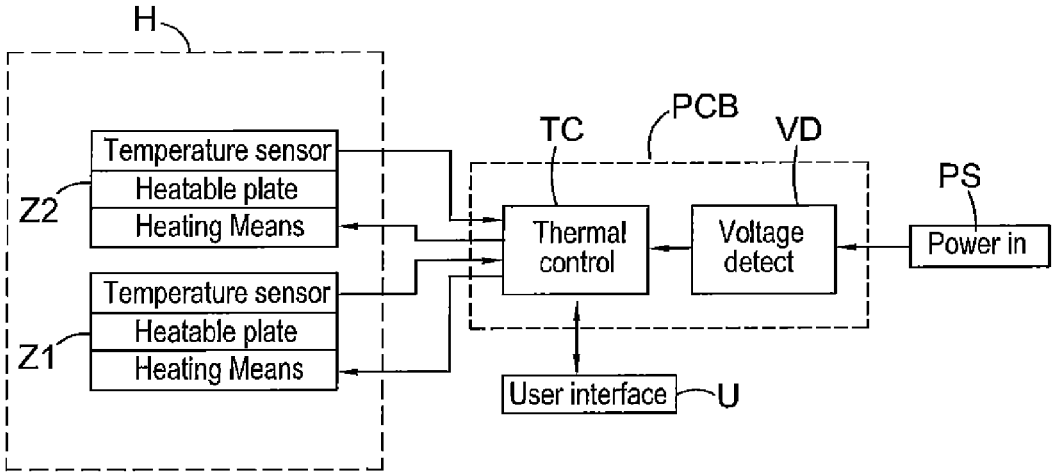
FIG. 12 depicts a schematic representation of an internal arrangement of a hair styling application according to the invention.

FIG. 12 depicts a schematic representation of the internal arrangement of an example of a hair styling appliance according to the present invention. In this particular embodiment, the hair styling appliance comprises a heater (H) having two heating zones (Z1, Z2). The hair styling appliance includes a control system having voltage detection means (VD) and thermal control means (TC). The voltage detection means are provided to control the input voltage from the power supply (PS). The thermal control means are provided to control the operation of the heating means of the two heating zones. Temperature sensors mounted in association with the heatable plate of each heating zone are configured to provide feed forward control data to the thermal control means. A user interface (U) allows a user to control the operation of the hair appliance as required.

The heating means of the heating zones may comprise heating elements in an overlapping formation. For example, a heating element may be arranged to overlie two or more adjacent heating elements.

The heating means of the heating zones may comprise heating elements arranged in a stacked (tiered) formation. The heating means may comprise a stacked array of thick film heaters. The array of thick film heaters may be created by sequentially screen printing resistive conductive layers and enamel layers.

The overlapping and/or layered heating elements of a heating means may be configured so as to provide a combined heating effect on the heatable plate of the heating zone. One or more of the heating elements may be configured to provide a background heating effect. Due to the combined heating effect, the operating voltage of each heating element may be reduced. As a result, the safety of the heating means is improved should a fault occur. If a heating element comprising a ceramic substrate is used, then the reduced operating voltage and thereby reduced operating temperature, also helps to prevent the cracking of the ceramic substrate.

The heating means of the heating zones may be configured so that the heating zones are operable under different operating conditions. The heating means may comprise overlapping and/or layered heating elements that are configured so that the heating means is operable under different operating voltage conditions. The heating means may comprise heating elements that are configured to be active or dormant depending on the operating voltage conditions. The heating means may be configured to provide an appropriate heating effect when operating under European mains voltage and/or US mains voltage.

FIGS. 13*a* to 13*d* depict schematic side views and a plan view of an example of heater comprising over-lapping heating elements that are configured to allow the heater to be operable under European mains voltage and US mains voltage. The heater has two heating zones (Z1, Z2) and comprises a heatable plate having a first heatable portion (P1) and a second heatable portion (P2) and a heating system (S) with three heating elements (E1, E2, E3). The first heating element (E1) and second heating element (E2) are smaller heating elements that are configured to provide zoned heating to the first heatable portion and second heatable portion of the heatable plate respectively. The third heater (E3) overlies both the first heat and second heater and it has an area that is greater than the sum of the areas of the smaller heaters but less than the area of the heatable plate.

Figure 13A:
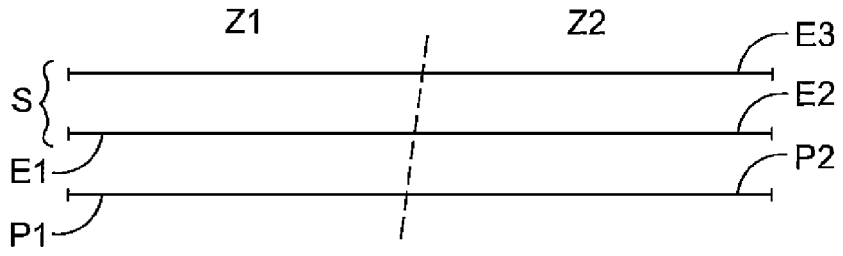
Figure 13B:
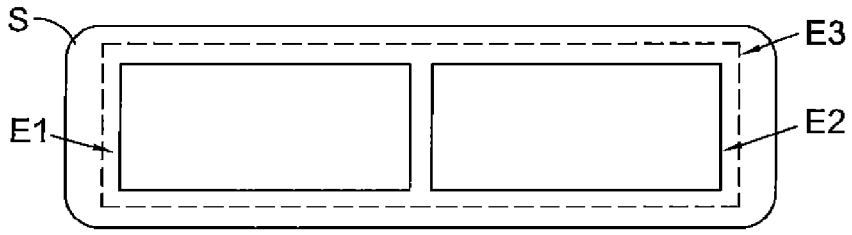
Figure 13C:
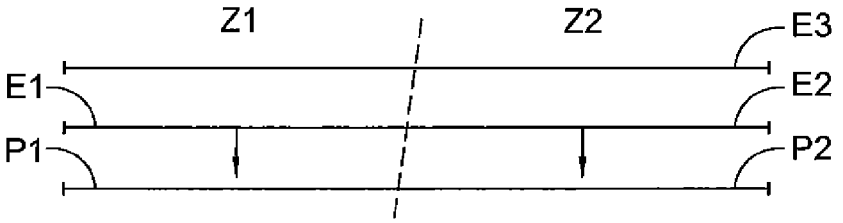
Figure 13D:
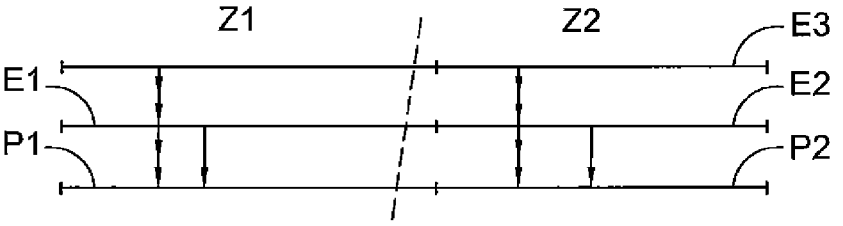

As shown in FIG. 13*c*, the first heater may heat the first heatable portion and the second heater may heat the second heatable portion when operating under European mains voltage conditions. When operating under US mains voltage conditions, the third heater is activated to provide a background heating effect with the first heater and the second heater. Accordingly, the first heater and third heater are configured to heat the first heatable portion and the second heater and third heater are configured to heat the second heatable portion when operating under US mains voltage as shown in FIG. 13*d*.

The heating means of the heating zones may be configured so as to reduce thermal stress between adjacent heating means. This may be achieved by increasing the mating contact between adjacent heating elements so as to improve thermal transfer between the heating elements. Thermal transfer improves the temperature gradient at the borders of the adjacent heating elements and thereby reduces thermal stress on the heating elements. Thus, the risk of cracking the heating elements is reduced and thinner heating element materials can be used. The reduction in thermal stress is particularly important when the heating element forms a layer of functional electrical insulation since any damage to the heating element may be safety relevant.

One or more of the heating elements may comprise heat transfer means to increase the mating contact and thereby improve the thermal transfer between adjacent heating elements. The heat transfer means preferably comprises one or more protruding means extending from the heating element. The heat transfer means may be mutually engaging. FIG. 14 depicts an example of a heater according to the present invention where a first heating element (A) is arranged in thermal contact with an adjacent, second heating element (B) so as to allow for thermal transfer between the adjacent heating elements and thereby reduce the temperature differential between the heating elements. The heating elements are arranged in thermal contact by interweaving (interleaving, inter-engaging) a finger portion (F1) of the first heating element with corresponding finger portions (F2) of a second heating element. Thus, if heating element A is activated, for example by a fault condition, and heating element B is not activated, heat is transferred from heating element A to heating element B such that the thermal gradient along the border edge of the heating elements is reduced.

The heating means of the heating zones may be additionally or alternatively configured as to reduce the power density in the border region of the adjacent heating means. The reduction in power density reduces the dissipation of heat from the border region of the adjacent heating elements and thereby reduces thermal stress. In one embodiment, the power density in the border region of the adjacent heating elements may be reduced by selectively spacing the adjacent heating elements. For example, adjacent heating elements may be selectively arranged with a gap space of approximately 1 micron to 1 cm, typically approximately 1 to 2 mm. In a second embodiment, the power density in the border region of adjacent heating elements means may be reduced by reducing the power density in the adjacent regions of one or both heating means. The power density in the adjacent regions of the heating means may be reduced by increasing the resistance of the resistive conductive tracks. The resistance of the resistive conductive tracks may be increased by reducing the conducting material. This may be achieved, for example, by reducing the width, thickness and/or length of the resistive conductive tracks. FIG. 15 depicts an example of a heater according to the present invention whereby the power density in adjacent regions of heating element A and heating element B have been reduced so as to reduce the dissipation of heat from the border region of the heating elements. The power density of heating element A varies along the longitudinal axis of the heating element between a high power density region A1 and a low power density region A2. The power density of the heating element B varies along the longitudinal axis of the heating element between a high power density region B1 and a low power density region B2. The power density in the heating elements may be varied by varying the width of the resistive conductive track along the longitudinal axes of the heating elements. So as to minimise the power density in the border region between heating element A and heating element B, the heating elements are configured such that low power density region A2 is arranged adjacent low power density region B2.

The heater of the hair styling appliance may comprise further heating zones to improve the thermal control of the heater. For example, the heater may comprise heating zones located at tips and/or along the edges of the heater. The heater may comprise heating zones arranged across the width of the heater. The heater may comprise heating zones arranged along the length and width of the heater so as to form a two-dimensional array of heating zones. The two dimensional array of heating zones may be arranged in a regular grid formation whereby the heating zones have uniform and regular shape. Alternatively, the two dimensional array of heating zones may be arranged in a non-regular grid formation whereby the heating zones have a non-uniform and/or irregular shape. These heating zones may be individually controllable so as to provide a desired heating effect and thereby aid the styling process. It is understood that the temperature across the width of a wide "salon" type heater can vary undesirably due to the thermal resistance across the width of the heatable plate. Therefore, an arrangement of multiple heating zones across the width of the heater helps to minimise this thermal variance problem. The heating zones may have a regular shape (i.e. rectangular or square) or non-regular shape. FIG. 16*a* depicts an example of a heater (H) comprising an two dimensional array of six independently operable heating zones (Z1-Z6) arranged in a regular grid formation across the heater. FIG. 16*b* depicts an example of a heater (H) comprising a two dimensional array of six independently operable heating zones (Z1-Z6) arranged along the length of the heater and across the width of the heater in a non-regular grid pattern.

The heater of the hair styling appliance may further comprise one or more cooling zones to reduce the temperature of the hair as desired. The cooling zones may be provided to reduce the temperature of the hair below the transition temperature so as to help set the hair in the moulded shape. The cooling zones may help to minimise unwanted kinking or curling of hair when pressure is removed. The cooling zones may be independently controllable. The cooling zones may be defined by cooling means arranged in thermal contact with cooling plate. The cooling means may be individually controllable. The cooling means may comprise any suitable means for cooling the cooling plate. For example, the cooling means may comprise micro-refrigeration means and/or thermoelectric cooling means that utilise the Peltier effect. The cooling zones may be defined by cooling means configured to direct cooling air over the hair.

Conventional hair styling appliances have a generally relatively complex construction involving many parts, which mean that the manufacturing process is labour intensive. Conventional hair styling appliances also have a generally bulky form, which means that they are difficult to handle, store and transport. Accordingly, the control means of the hair styling appliance according to the present invention may comprise a flexible PCB to control the operation of one or more heaters. The flexible PCB is thin, lightweight and reduces the number of wire connections in a hair styling appliance. It therefore simplifies the assembly of a hair styling appliance and improves the overall size, shape and weight of the hair styling appliance.

The flexible PCB may be dual or single component side. The flexible PCB enables multiple connections to be made simply, robustly and quickly without requiring wiring looms. This reduces the cost and complexity of manufacture. Further, when using a multi-zoned heater, the number of connections increases with each zone and hence a low cost, compact and rapid method of making connections is important.

The flexible PCB is heat-staked to each of the heating means of the heaters so as to allow independent control of the heating zones. When heat-staking the flexible PCB to the heating means, the heater connections are coated in solder paste and the heating means is heated up to just below the melt point of the solder. The heat stake is then applied. This is required because the heating means is designed to have a high thermal conductivity and hence without self heating, the connections could become unreliable. The flexible PCB thereby allows for a connection component that minimises thermal stress and provides an extended life cycle.

FIG. 17 schematically depicts an example of a hair straightener according to the present invention whereby a flexible PCB (F) is coupled to the heater (H) in each jaw. So as to provide independently operable heating zones, the flexible PCB is heat-staked to the heating means of each heating zone.

The heater according to the present invention may comprise resilient insulating means to minimise heat loss from the heating means and improve thermal conductance between the heating means and heatable plate of a heating zone. The resilient insulating means comprises insulating means and biasing means and is configured to be mounted to the rear of the heating means. The insulating means are configured to insulate heating means and thereby minimise heat loss from the rear of the heating means. The biasing means are configured to resiliently bias the heating means towards the heatable plate and thereby improve thermal contact between the heating means and the heatable plate.

FIG. 18 depicts a cross-sectional view of an example of a heating zone of a heater according to the present invention. The heating zone comprises a heatable plate (P), a thermal interface material (M), a thick film ceramic heating element (E) and a resilient insulating means (RI). The resilient insulating means is resiliently mounted to the rear of a heating means. The resilient insulating means comprises a spring. The spring comprises silicon and has a standing wave configuration. The spring acts as a thermal insulator to the heating means and so helps to minimise heat loss from the heating means. The spring also urges the heating means towards the heatable plate and so helps to improve thermal conductivity between the heating means and heatable plate. Due to the configuration of the spring, only the peaks of the spring form a mating contact with the heating means. Thus, mating contact and therefore thermal contact, is minimised between the spring and heating means.

FIG. 19 depicts a cross-sectional view of a jaw (J) of a hair styling appliance according to the present invention. The jaw comprises a heatable plate (P) having a hair contacting face. On the opposing side of the heatable plate, there is provided a thick film ceramic heating element (E). A layer of thermal interface material (M) is provided between the heating element and the heatable plate. The heatable plate and heating element are mounted to a heater carrier (C). A resilient insulating means (RI) is provided between the heating element and the heater carrier.

The heater carrier is in turn mounted to a chassis (CH) which forms the main body of the jaw. Heater surrounds or shrouds (S) extend from the chassis on opposing sides of the heater carrier and plate so as to prevent a user from accidentally contacting the plate.

The chassis is provided with a longitudinal extending channel within which a strip of thermally insulating material is located. The material may take the form of nanoporous aerogel material of the type commonly known as Pyrogel (PY). The chassis is surmounted by a cover (CO).

The arrangement of the jaw reduces thermal mass, improves thermal conductance between the heating means and the heatable plate and reduces heat loss. The ceramic of the heating means helps to provide the required electrical resistance. The thermal interface material improves thermal conduction. The resilient insulating means helps to minimise heat loss and improve thermal conduction. For low voltage systems, the heating means may be printed directly onto a thin electrically insulating layer coated or formed on the heatable plate, thereby further providing a better thermal link. The pyrogel insulation reduces the temperature of the outer casing, thereby allowing standard temperature plastics to be used which are more aesthetically pleasing.

The control means of the hair styling appliance may further comprise microprocessing means that allows for complex control of the heaters. For example, the control means may comprise means to adjust the power delivered to heaters by using an on/off triac based upon the output of the temperature sensors.

The control means may comprise a number of transfer functions such as:

simple on-off control means or bang-bang control means;
proportional-integral-derivative (PID) control means;
fuzzy logic;
neural network and adjustable rule bases;
feed back control means;
feed forward control means.

The control means may comprise means to measure the input voltage or alternatively to detect the speed at which the heaters heat up so as to detect the type of input voltage. A high input voltage would lead to a faster heat up of the heaters and hence the control loop can react appropriately. The input voltage and/or speed of heat up can also be used to detect a failure.

The control means may comprise means to detect the use of the hair styling appliance and control the power supply to the heaters accordingly. This feature helps to reduce power consumption and improve safety. For example, the control means may comprise means to reduce the temperature of the heaters when they are not active and then rapidly heat them up when they are about to be used. The control means may allow a heater to power down to a standby temperature if a user momentarily places the hair styling appliance on a table. The control means may then power up the heater to an operating temperature when the hair styling appliance is picked up to be used.

Detection of use may be achieved by detecting the opening and closing of the hair styling appliance or through the use of an accelerometer or capacitive touch system to detect the motion of the hair styling appliance. The control means may comprise inclination sensing means to detect the inclination of the hair styling appliance.

If the control means detect that the hair styling appliance has not been used for a longer period of time, then the control means may shut down the hair styling appliance. This enables the hair styling appliance to meet the mandatory requirement of the safety standard that the appliance must turn off after 30 minutes whether it is being used or not.

The control means may comprise feed forward control. The feed forward control will use an input parameter to control the operation of the hair styling appliance. The feed forward control can improve the reaction time of a predictive system. FIG. 20 depicts an example of feed forward control architecture whereby disturbance data (DISTURBANCE) and input data (INPUT) are combined at a summation point (SP) so as to control the output (OUTPUT) of a system (SYSTEM).

So as to provide feed forward control, the control means may comprise sensing means to determine a characteristic of the hair loaded on the heater and modify the operation of the hair styling appliance accordingly. Control means having feed forward control may include capacitive sensing means to detect the amount of hair between the heatable plates and work along with the temperature sensing means to increase or decrease the power to the heatable plates accordingly. Control means having feed forward control may use relative temperature changes in the temperature sensors of the heating zones to provide better control. Control means having feed forward control may include an LED array/photodiodes/photosensor along the edge of a heatable plate to detect the amount and type of hair and adjust the power supply accordingly. For example, fine blond hair has a lower transition temperature and so the heaters require less power.

As mentioned previously, the ceramic substrate of a heating means may be used as an electrical insulator for health and safety purposes. Hence, if a ceramic heating element is used to heat a heatable zone then the control means may comprise means to detect any cracking of the ceramic substrate to prevent high voltage leakage to the heatable plate. The control means may comprise resistance measuring means to detect the resistance of the heating elements to detect cracking.

The hair styling appliance according to the present invention may be operated using:

a mains voltage power supply;
a battery power supply, including rechargeable battery supply; or
an extra low voltage power supply.

The extra low voltage power is preferably a safety extra low voltage. The extra low voltage may be provided by using a mains transformer or an isolated power supply.

The extra low voltage systems advantageously require less electrical insulation. The thermal insulation and thermal resistance of the hair styling appliance is thereby reduced.

When using an extra low voltage power supply, an AC to AC frequency switching supply may be used rather than an AC to DC supply so as to reduce cost.

The hair styling appliance according to the present invention may further comprise means for providing a polyphonic sound. The means may provide a particular sound brand or jingle when switching on and/or off. The means may provide a sound to indicate particular events, such as reaching a desired operating temperature and/or sleep mode.

The hair styling appliance according to the present invention may comprise lighting means. The lighting means may provide a pleasing aesthetic appearance as well as indicate temperature or other events. The lighting means may comprise an electroluminescent backlight as it enables wide angle, wide area viewing. Alternatively or additionally, the lighting means may comprise an LED lighting with a suitable light-pipe and/or optical diffuser.

Throughout the description and claims of this specification, the words "comprise" and "contain" and variations of the words, for example "comprising" and "comprises" means "including but not limited to", and is not intended to (and does not) exclude other moieties, additives, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. A hair styling appliance comprising a heater having a plurality of heating zones, wherein the temperature of each of the plurality of heating zones is independently controllable and wherein the plurality of heating zones are arranged sequentially immediately next to one another along the length of the heater in a direction parallel to a longitudinal axis of the heater so that the heater provides a continuous heating surface along the length of the heater.

2. A hair styling appliance according to claim 1, further comprising heating zones arranged across the width of the heater.

3. A hair styling appliance according to claim 1, wherein each heating zone comprises one or more heating elements arranged in thermal contact with a portion of a heatable plate that is provided in common with said heating zones.

4. A hair styling appliance according to claim 3, wherein one or more of the heating zones comprises a temperature sensor arranged in thermal contact with the heatable plate.

5. A hair styling appliance according to claim 3 wherein the heating elements are overlapping heating elements.

6. A hair styling appliance according to claim 3, wherein the heating elements are a stacked array of heating elements.

7. A hair styling appliance according to claim 3, wherein one or more of the heating elements comprise a finger portion protruding from the heating element for thermally engaging an adjacent heating element.

8. A hair styling appliance according to claim 3 wherein a heating element is configured to reduce the power density in a border region of the heating element and an adjacent heating element.

9. A hair styling appliance according to claim 8, wherein the heating element is arranged a predetermined distance from the adjacent heating element.

10. A hair styling appliance according to claim 8, wherein the heating element comprises a reduced power density region configured to face the adjacent heating element.

11. A hair styling appliance according to claim 3, wherein the heating zones comprise a resilient spring to insulate the heating element.

12. A hair styling appliance according to claim 3, further comprising a control system for controlling the operation of the heating zones.

13. A hair styling appliance according to 12, wherein the control system comprises a flexible printed circuit board coupled to the heating zones.

14. A hair styling appliance according to claim 12, wherein the control system comprises a detector for detecting changes in the position or movement of the hair styling appliance, predicting the intended use of the hair styling appliance and operating the heating zones according to the predicted use.

15. A hair styling appliance according to claim 12, wherein the control system comprises a detector for detecting characteristics of the hair loaded on the heater and operating the heating zones accordingly.

16. A hair styling appliance according to claim 1, wherein each heating zone comprises one or more heating elements arranged in thermal contact with a respective heatable plate.

17. A hair styling appliance according to claim 1, wherein the hair styling appliance is a hair straightener comprising a pair of hinged jaws, wherein said heater is provided on one of said pair of hinged jaws and wherein another of said heaters is provided on the other one of said pair of hinged jaws.

18. A hair styling appliance according to claim 1 wherein the hair styling appliance is a curling tong.

19. A hair styling appliance according to claim 1 wherein the hair styling appliance is a curling wand.

20. A hair styling appliance according to claim 1, wherein the hair styling appliance is a crimping iron comprising a pair of hinged jaws, wherein said heater is provided on one of said pair of hinged jaws and wherein another of said heaters is provided on the other one of said pair of hinged jaws.

21. A heater suitable for a hair styling appliance, wherein the heater comprises a plurality of independently controllable heating zones, wherein the temperature of each heating zone is independently controllable, the heating zones being arranged sequentially immediately next to each other along a longitudinal length of the heater so that the heater provides a continuous heating surface along the length of the heater.

22. A heater according to claim 21, further comprising heating zones arranged across the width of the heater.

23. A method of operating a hair styling appliance as defined in claim 1 comprising controlling the supply of power to the heating elements of each of the heating zones so as to provide a desired heating effect.

24. A hair styling appliance comprising a heater having a plurality of heating zones and a heatable plate, wherein the temperature of each of the plurality of heating zones is independently controllable and wherein the heating zones are arranged sequentially immediately next to each other along a longitudinal length of the heatable plate so that the heatable plate provides a continuous heating surface along the length of the heatable plate.

25. A hair styling appliance according to claim 24, wherein each heating zone comprises one or more heating elements arranged in thermal contact with a portion of the heatable plate.

26. A hair styling appliance comprising a heater having a plurality of heating zones, wherein the temperature of each of the plurality of heating zones is independently controllable and comprises a separate heatable plate, wherein the plurality of heating zones are arranged sequentially immediately next to one another along the length of the heater in a direction parallel to a longitudinal axis of the heater so that the heater provides a continuous heating surface along the length of the heater.

* * * * *